US006213680B1

(12) United States Patent
Schaeffer et al.

(10) Patent No.: US 6,213,680 B1
(45) Date of Patent: Apr. 10, 2001

(54) APPARATUS AND METHOD FOR INTEGRATED PAVEMENT MARKING

(75) Inventors: James Kenyon Schaeffer, Englewood; Roger D. Randall, Parker; John L. Edwards, Franktown; Brian D. Huffman, Windsor; Jack L. Crosby, Brighton; Paul Svaldi, Golden, all of CO (US)

(73) Assignee: Interstate Highway Construction, Englewood, CO (US)

( * ) Notice: Subject to any disclaimer, the term of this patent is extended or adjusted under 35 U.S.C. 154(b) by 0 days.

(21) Appl. No.: 09/302,831

(22) Filed: Apr. 30, 1999

Related U.S. Application Data

(60) Provisional application No. 60/083,786, filed on May 1, 1998.

(51) Int. Cl.[7] ..... E01C 23/08; E01C 23/02

(52) U.S. Cl. ..... 404/92; 404/93; 404/94; 404/107; 404/108

(58) Field of Search ..... 404/92, 93, 94, 404/95, 96, 107, 108, 114; 366/10, 17, 22, 23, 33

(56) References Cited

U.S. PATENT DOCUMENTS

| | | | |
|---|---|---|---|
| 1,928,551 | 9/1933 | Ball | 91/39 |
| 2,013,406 | 9/1935 | Gibbs | 94/45 |
| 2,346,379 | 4/1944 | Jackson | 94/24 |
| 2,691,923 | 10/1954 | Huck | 94/44 |
| 3,217,617 | 11/1965 | Wiswell | 94/22 |
| 4,136,991 | 1/1979 | Clark et al. | 404/73 |
| 4,256,261 | 3/1981 | Gurney | 239/155 |
| 4,269,328 | 5/1981 | Franklyn | 222/146 |
| 4,505,356 | 3/1985 | Baier et al. | 180/322 |
| 4,540,438 | 9/1985 | Gutmann et al. | 106/97 |
| 4,576,122 | 3/1986 | Marcato | 122/26 |
| 4,579,459 | 4/1986 | Zimmerman | 366/27 |
| 4,830,533 | 5/1989 | Miller | 404/101 |
| 5,044,819 * | 9/1991 | Kilheffer et al. | 404/72 |
| 5,114,268 | 5/1992 | Marcato | 404/92 |
| 5,135,332 | 8/1992 | Hellwig et al. | 404/89 |
| 5,340,652 | 8/1994 | Sondhe et al. | 428/413 |
| 5,439,312 | 8/1995 | Marcato | 404/12 |
| 5,439,313 | 8/1995 | Blaha et al. | 404/75 |
| 5,511,896 | 4/1996 | Marcato | 404/72 |
| 5,516,227 | 5/1996 | Kozak et al. | 404/9 |
| 5,557,461 | 9/1996 | Wyckoff | 359/551 |
| 5,570,953 | 11/1996 | DeWall | 366/10 |
| 5,642,962 | 7/1997 | Marcato | 404/94 |
| 5,662,430 | 9/1997 | Lee | 404/15 |
| 5,746,539 | 5/1998 | Mara | 404/84.05 |
| 5,951,201 | 9/1999 | Jones | 404/94 |

FOREIGN PATENT DOCUMENTS

| | | |
|---|---|---|
| 2451324 A1 | 5/1976 | (DE) . |
| WO 87/02724 | 5/1987 | (WO) . |

* cited by examiner

*Primary Examiner*—Eileen D. Lillis
*Assistant Examiner*—Gary S. Hartmann
(74) *Attorney, Agent, or Firm*—Sheridan Ross P.C.

(57) ABSTRACT

Apparatus and methods are provided for filling a groove in a pavement with a groove filling grout. The present invention is used for forming pavement markings, such as lane striping.

81 Claims, 8 Drawing Sheets

APPARATUS AND METHOD FOR INTEGRATED PAVEMENT MARKING

CROSS-REFERENCE TO RELATED APPLICATIONS

This application claims the benefit of U.S. Provisional Application No. 60/083,786, filed May 1, 1998, which is incorporated by reference herein in its entirety.

FIELD OF THE INVENTION

The present invention relates generally to apparatus and methods for pavement marking and, in particular, to apparatus and methods for forming long-lasting pavement marking by filling a groove in the pavement with marking grout.

BACKGROUND OF THE INVENTION

Currently, most concrete or asphalt pavements are painted or taped to form pavement markings, such as lane striping, turn arrows, etc. Due to poor wear resistance, these methods necessitate frequent renewal by reapplying the tape or re-painting the marking at considerable expense and effort.

Another method for marking pavements is to permanently attach a reflective element to the pavement. Because these reflectors typically protrude significantly above the surface of the pavement, they can not be used in areas where snow removal is required. Such protruding elements also disrupt the flat surface of the pavement.

Still another method involves creating an indentation on a soft concrete road surface, filling the indentation with white mortar and finishing the surface to provide pavement stripes or other marks.

In spite of these methods, there remains a need for an apparatus and a method for providing a long-lasting pavement marking. It would be advantageous to provide a method and apparatus which are efficient, and involve a minimal amount of manual labor. It would be advantageous to provide a method and apparatus for forming pavement markings which are highly mechanized and automated. It would be advantageous to provide a method and apparatus for forming pavement markings which include feedback control of various operations. It would be advantageous to provide a method and apparatus for forming pavement markings which are relatively quick in that a high amount of marking can be formed in a limited amount of time. It would be advantageous to provide a method and apparatus for forming pavement markings which are long lasting relative to paint and tape. It would be advantageous to provide a method and apparatus for forming pavement markings on a formed surface, such as cured concrete or compacted asphalt. It would advantageous to provide a method and apparatus for forming pavement markings which are applicable under various weather conditions. It would be advantageous to provide a method and apparatus for forming pavement markings which results in a relatively smooth pavement surface.

SUMMARY OF THE INVENTION

The present invention provides a method and apparatus for forming long-lasting pavement markings. In particular, the present invention provides a pavement groove filling method and apparatus which can be used for forming long-lasting markings on pavement.

In accordance with an embodiment of the present invention, a grout dispensing apparatus is provided. The grout dispensing apparatus includes a grout hopper for storing grout, an material gate having open and closed positions operatively connected to the grout hopper for dispensing the grout from the grout hopper into a pavement groove when the material gate is in the open position, a side form for confining the grout substantially within the side boundaries of the pavement groove, and a strike-off pan for leveling the grout in the pavement groove.

In preferred embodiments, the grout dispensing apparatus can include one or more of the following:

- a grout-hopper vibrator for vibrating the grout hopper;
- a grout-hopper grout agitator for maintaining homogeneity of the grout in the grout hopper;
- a smoothing plate for smoothing the grout surface in the pavement groove;
- a smoothing-plate vibrator operatively connected to the smoothing plate for vibrating the smoothing plate;
- a visibility-enhancing agent application device for spraying and/or embedding a visibility-enhancing agent on the grout surface in the pavement groove;
- a grout-surface air spray device for removing non-embedded visibility-enhancing agent from the grout surface in the pavement groove;
- a curing-agent application device for spraying a curing agent onto the grout surface in the pavement groove;
- a rollable support system having a longitudinal and/or transversal suspension system;
- a lifting mechanism for lifting the grout dispensing apparatus off from a pavement surface and returning the apparatus to the pavement surface; and/or
- a guiding device for guiding the grout dispensing apparatus into a proper position to fill the pavement groove.

In accordance with another embodiment of the present invention, a grout preparation apparatus is provided. The grout preparation apparatus includes a product hopper for storing a dry particulate material, a product dispensing device for dispensing at least a portion of the dry particulate material from the product hopper, a grout mixer operatively connected to the product-dispensing device for mixing the dry particulate material with a liquid to produce the grout, and a surge hopper operatively connected to the grout mixer for storing the grout. Preferably, the grout preparation apparatus is operatively connected with a grout dispensing apparatus.

In preferred embodiments of the present invention, the grout preparation apparatus can include one or more of the following:

- a product-hopper vibrator for vibrating the product hopper;
- a product-hopper air pad located in the interior of the product hopper for providing air flow into the product hopper to reduce the amount of agglomeration formation by the dry particulate material;
- a product temperature sensor for determining the temperature of the dry particulate material;
- a product heater operatively connected to the product temperature sensor for heating the dry particulate material;
- a product dispensing device in the form of an auger;
- a liquid storage device operatively connected to the grout mixer for storing liquid;
- a liquid inlet operatively connected to the liquid storage device for supplying liquid to the grout mixer;
- a temperature sensor for determining the temperature of the liquid in the liquid storage device;

a liquid heater operatively connected to the liquid temperature sensor for heating the liquid;

a surge-hopper grout agitator for maintaining homogeneity of the grout in the surge hopper;

a surge-hopper grout level sensor, wherein the surge-hopper grout level sensor is operatively connected to the grout mixer for controlling the production of grout; and/or an ultrasonic surge-hopper grout level sensor.

Preferably, the grout preparation apparatus further includes a grout dispensing device for dispensing the grout from the surge hopper to the grout hopper of a grout dispensing apparatus. The grout dispensing device can be a peristaltic pump. The grout hopper can include a grout-hopper grout level sensor operatively connected to the grout dispensing device for controlling the grout dispensing device. The grout preparation apparatus and/or the grout dispensing apparatus can further include a groove clearing air spray device for clearing the pavement groove of debris and/or a mist spray device for spraying water mist into the pavement groove.

In another embodiment of the present invention, a self-propulsion device is provided. The self-propulsion device includes an engine for self-propulsion, a control panel operatively connected to the engine, a swing arm, wherein the swing arm allows placement of the control panel on the right side or the left side of the self-propulsion device, and a grout dispensing apparatus and/or a grout preparation apparatus.

Preferably, the self-propulsion device includes a speed control dial for controlling the speed of the self-propulsion device and/or a steering device for controlling the direction of travel of the self-propulsion device.

In accordance with another embodiment of the present invention, a method for making a long-lasting pavement marking is provided. The method includes the steps of removing a portion of the pavement to create a pavement groove, placing grout in the pavement groove, leveling the grout in the pavement groove to substantially the same level as the pavement, and embedding a visibility-enhancing agent in the grout. Preferably, the pavement groove is cleared of debris before placing the grout in the groove. Air can be applied to the pavement groove to assist in the removal of debris. Preferably a grout curing agent is applied to aid in the curing of the grout once it is placed in the groove.

The present invention provides one or more of the following advantages:

a method and apparatus which are efficient, and involve a minimal amount of manual labor;

a method and apparatus for forming pavement markings which are highly mechanized and automated;

a method and apparatus for forming pavement markings which include feedback control of various operations;

a method and apparatus for forming pavement markings which are relatively quick in that a high amount of marking can be formed in a limited amount of time;

a method and apparatus for forming pavement markings which are long lasting relative to paint and tape;

a method and apparatus for forming pavement markings on a cured surface, such as cured concrete or compacted asphalt;

a method and apparatus for forming pavement markings which are applicable under various weather conditions; and/or a method and apparatus which results in a pavement having a relatively smooth surface after the formation of the pavement markings.

DETAILED DESCRIPTION OF THE INVENTION

Unless otherwise stated, the following terms will have the following meanings as used in the present application.

A "hopper" refers to any receptacle for the storage of material. Preferably, the hopper is funnel- or conical-shaped.

A "pavement" refers to any paved surface, preferably asphalt or concrete. Although the pavement need not be completely cured, it should be sufficiently cured or compacted to enable the pavement treatment apparatus of the present invention to be placed on the pavement surface without causing undesired indentations. Exemplary pavements include, but are not limited to, roads; highways; parking lots; sidewalks; airport runways, aprons, taxiways and access routes; and floors.

A "groove" refers to any channel or depression in a pavement. Preferably, the groove has side walls which are relatively perpendicular to the pavement surface, and a bottom surface which is relatively parallel to the pavement surface, but at a lower level than the pavement surface. Due to the preferred method of forming the groove, the bottom surface of the groove is generally of a rough, uneven texture.

Preferably, the depth of the groove is from about 0.1 cm to about 1.5 cm, more preferably from about 0.2 cm to about 1 cm, and most preferably from about 0.3 cm to about 0.7 cm. The groove can be of any width suitable for the desired application. For example, the width for lane striping will be approximately 10 cm, while the width of a turn signal may be 1 meter or more.

A "long-lasting pavement marking" refers to a pavement marking which lasts at least about 10 years under normal usage, preferably at least about 20 years, more preferably at least about 30 years, and most preferably for the duration of a useful life of the pavement.

"Grout" refers to any flowable material, and is preferably a mixture of a liquid, such as water, and a dry particulate material, such as cement. Preferably the grout is a flowable viscous paste which can be poured into a groove and sets to form a hard long-lasting solid.

"Homogeneity" of grout refers to a mixture of dry particulate material and a liquid where the dry particulate material is substantially evenly mixed with the liquid, producing a substantially homogeneous mixture.

A "leveled grout" refers to a grout which has been placed in a groove where the height of the grout is substantially equal to the adjacent pavement surface level.

The present invention will be described with regard to the accompanying drawings which assist in illustrating various features of the invention. In this regard, the present invention generally relates to a pavement groove filling apparatus and a method for forming a long-lasting pavement marking.

Figure 1:
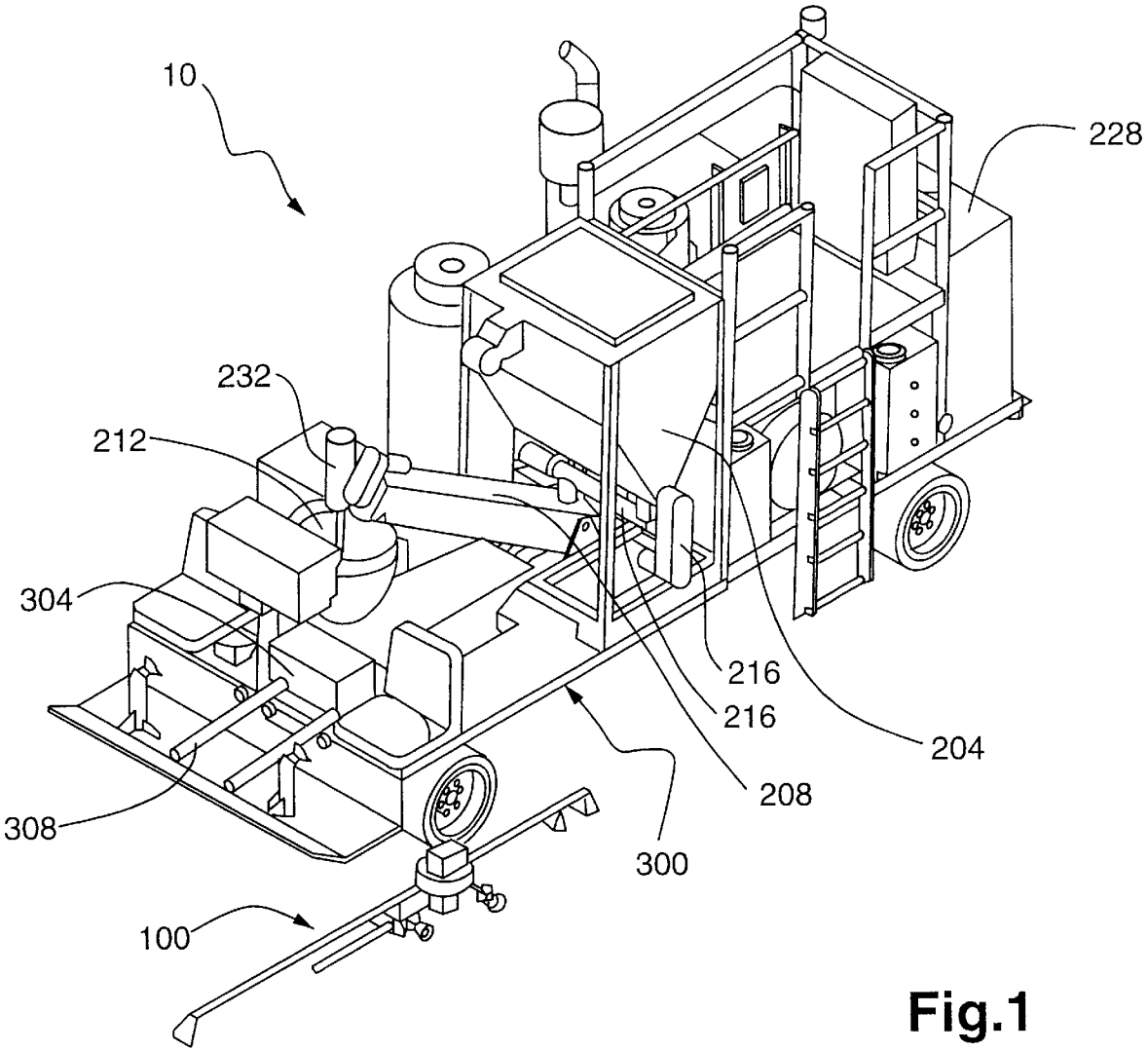
FIG. 1 is a perspective view of one embodiment of a self-propelled pavement groove filling apparatus of the present invention with a grout dispensing apparatus removably attached to a self-propulsion device.
Figure 2:
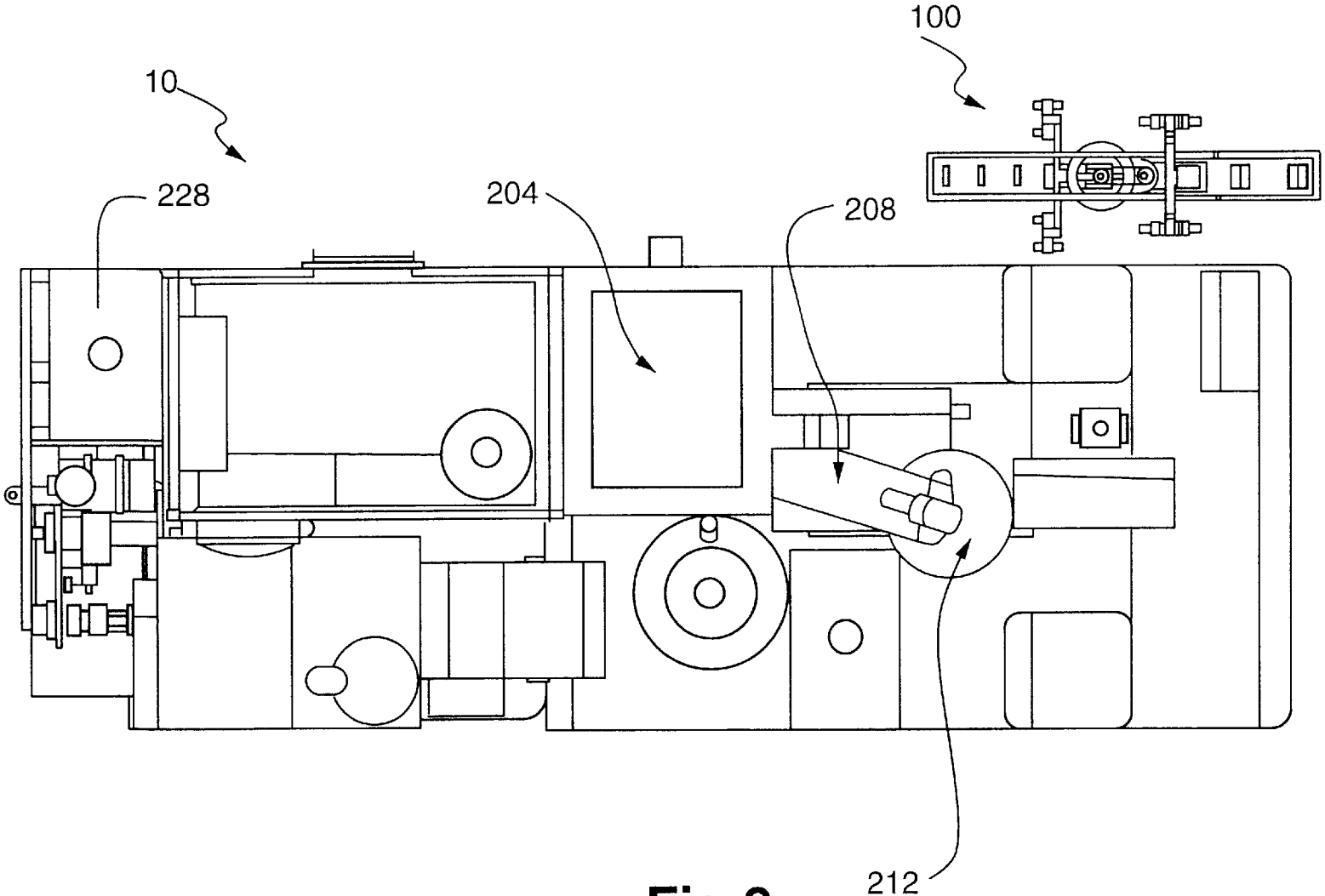
FIG. 2 is a top view of one embodiment of a self-propelled pavement groove filling apparatus of the present invention with a grout dispensing apparatus removably attached to a self-propulsion device.
Figure 3:
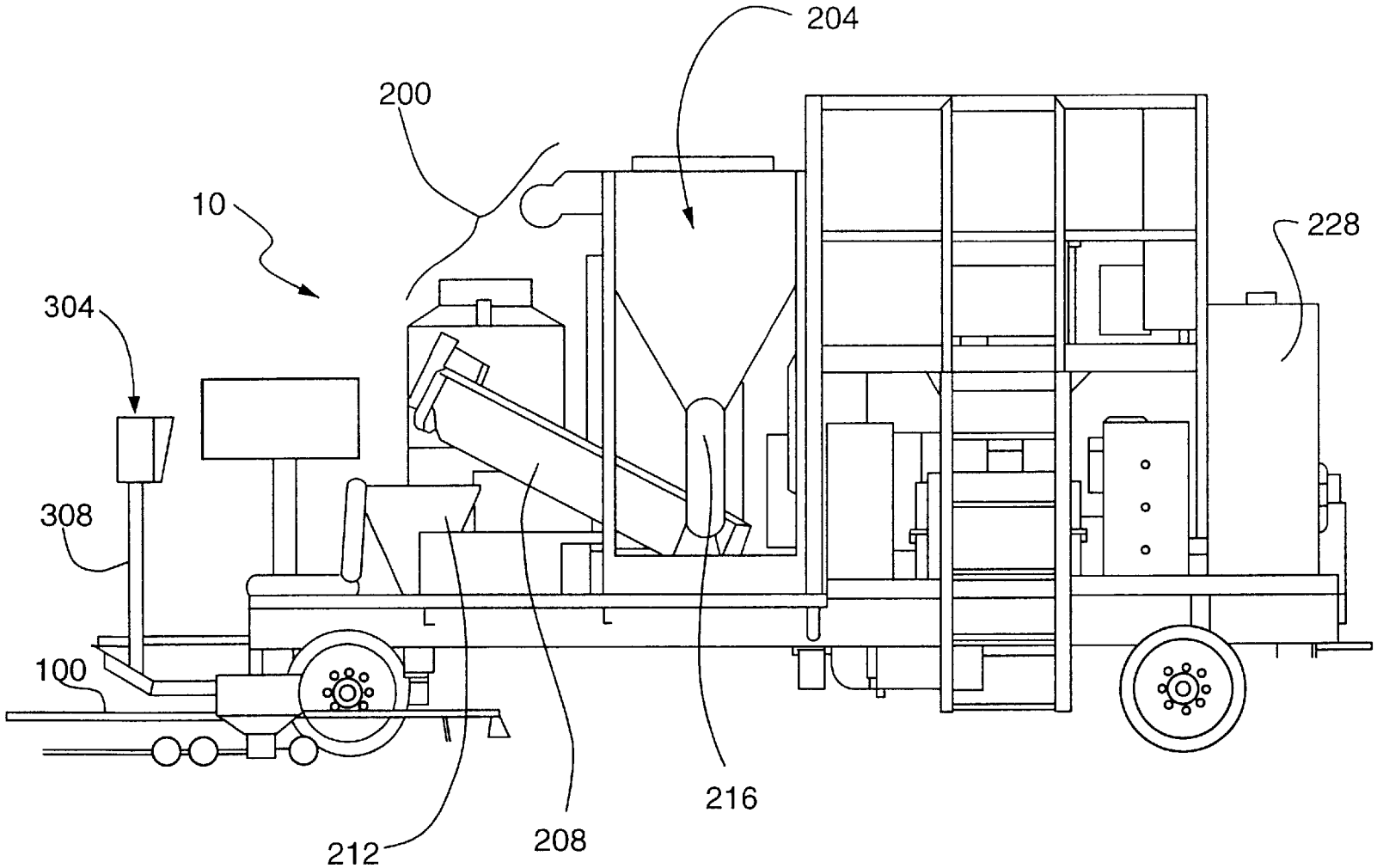
FIG. 3 is a side view of one embodiment of a self-propelled pavement groove filling apparatus of the present invention with a grout dispensing apparatus removably attached to a self-propulsion device.
Figure 5:
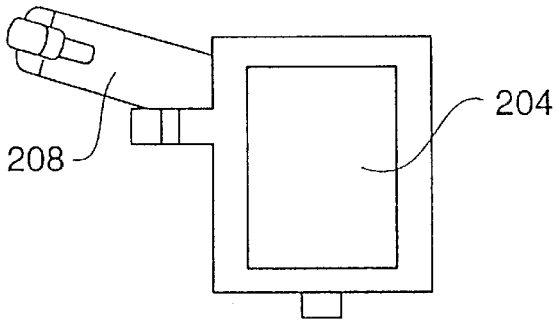
FIG. 5 is a top view of a grout preparation apparatus of the present invention showing a dry product hopper and a grout mixer.
Figure 4:
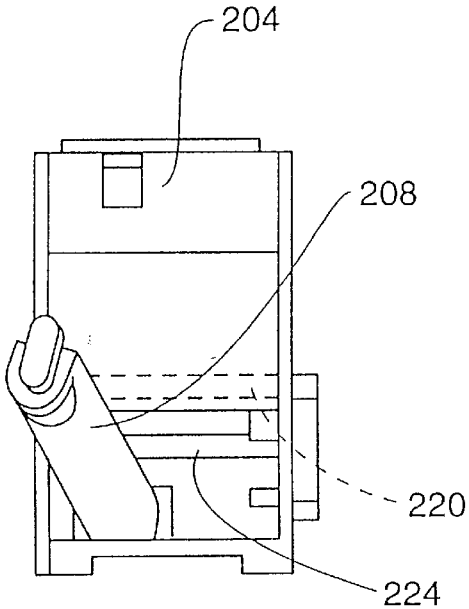
FIG. 4 is a front view of a grout preparation apparatus of the present invention showing a dry product hopper and a grout mixer.
Figure 6:
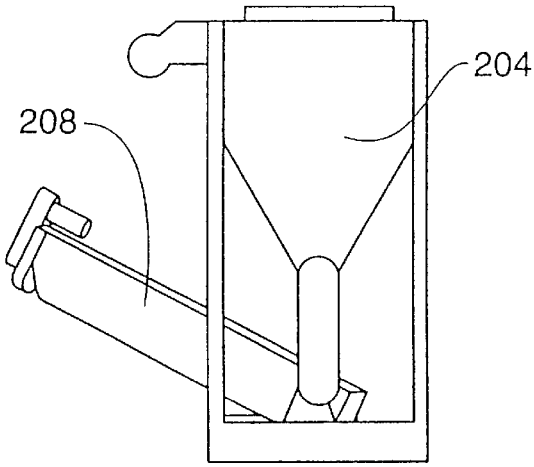
FIG. 6 is a side view of a grout preparation apparatus of the present invention showing a dry product hopper and a grout mixer.
Figure 7:
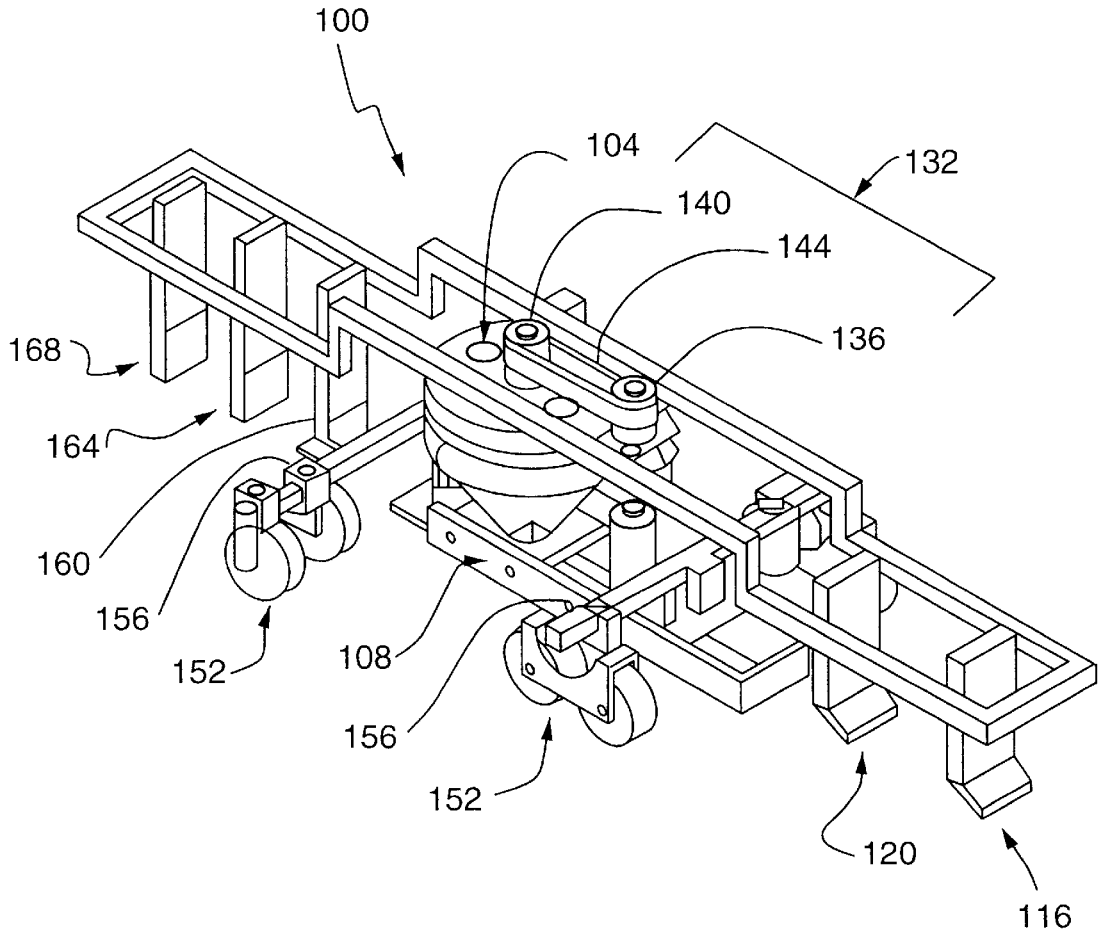
FIG. 7 is a perspective view of a grout dispensing apparatus of the present invention.
Figure 8:
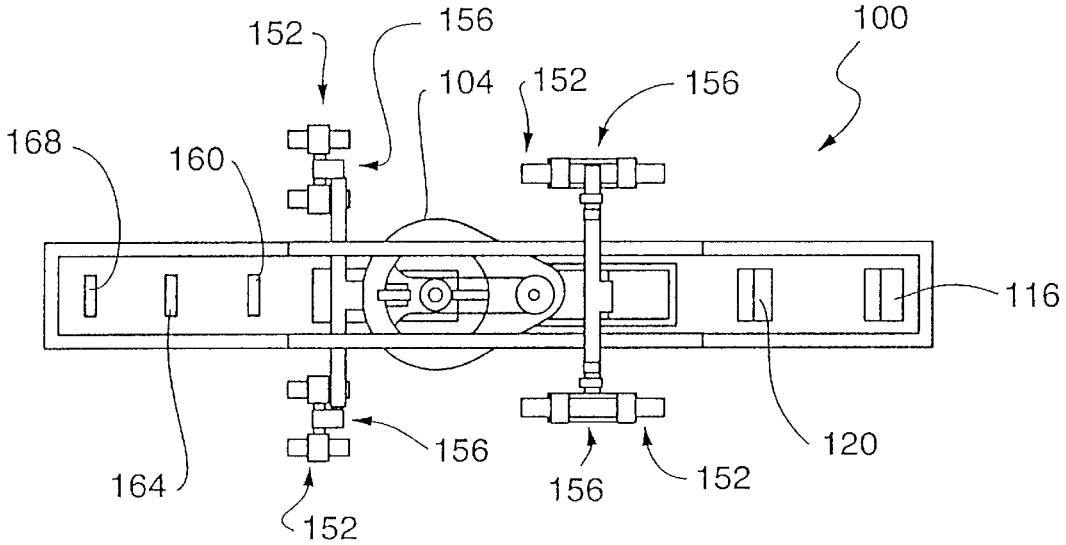
FIG. 8 is a top view of a grout dispensing apparatus of the present invention.
Figure 9:
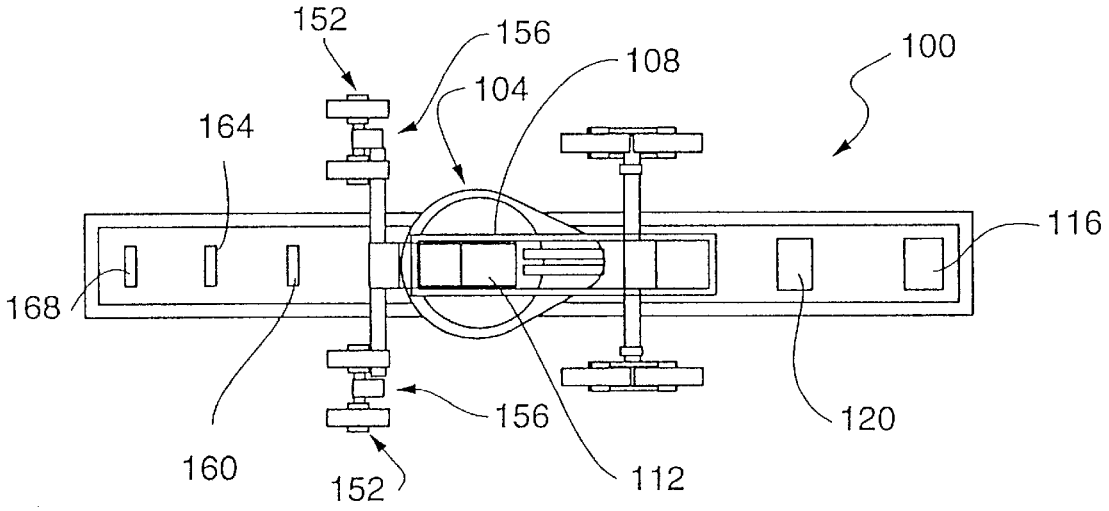
FIG. 9 is a bottom view of a grout dispensing apparatus of the present invention.
Figure 10:
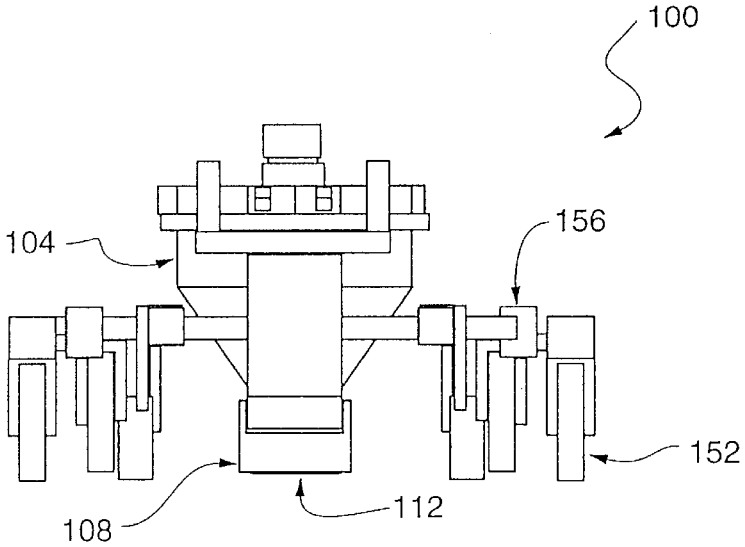
FIG. 10 is an end view of a grout dispensing apparatus of the present invention.
Figure 11:
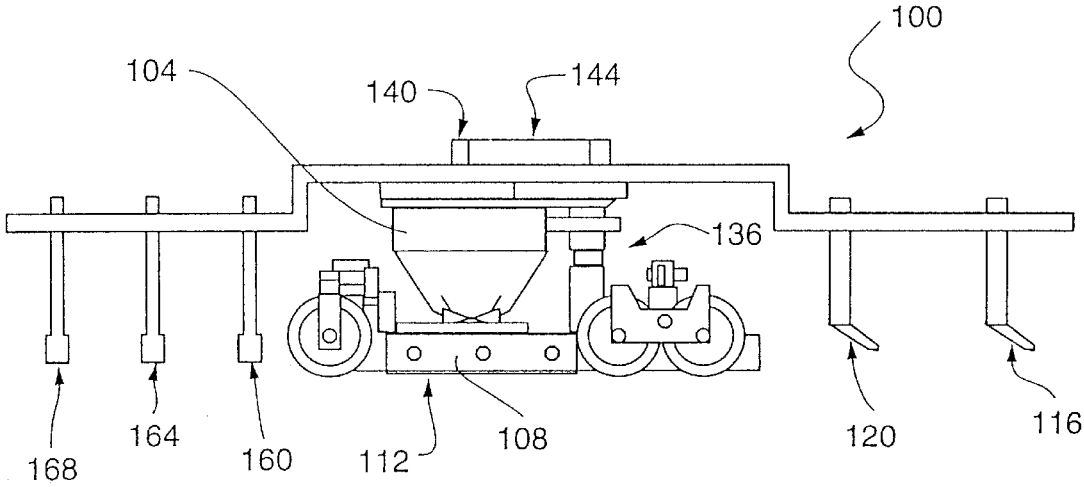
FIG. 11 is a side view of a grout dispensing apparatus of the present invention.
Figure 12:
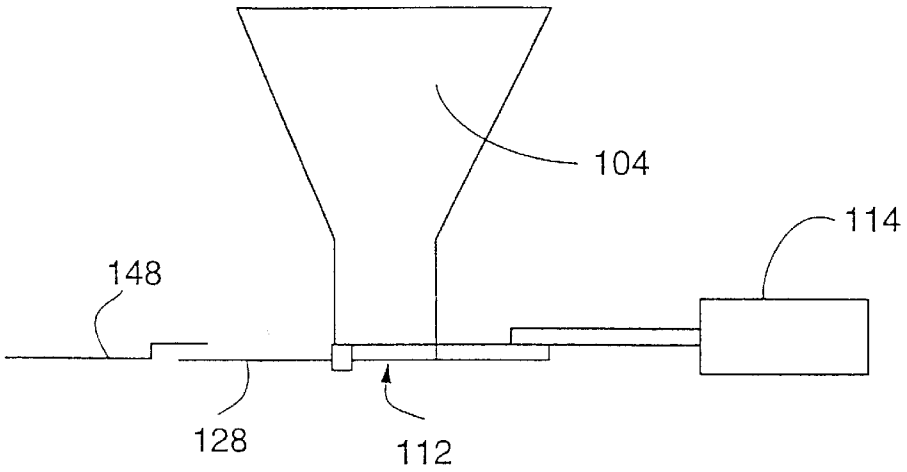
FIG. 12 is an exploded view of a grout hopper of the present invention.
Figure 13:
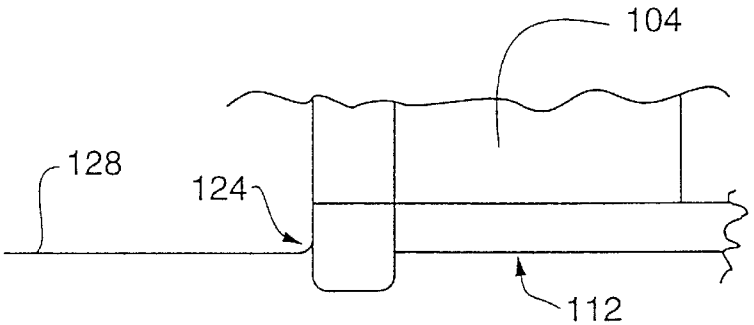
FIG. 13 is an exploded view of an extrusion pan of the present invention.

One embodiment of a pavement groove filling apparatus is generally illustrated in FIG. 1. The pavement groove filling apparatus 10 includes a grout dispensing apparatus 100 and a grout preparation apparatus 200. The grout dispensing apparatus 100 can be permanently attached to the grout preparation apparatus 200, or it can be removably attached. Preferably, the grout dispensing apparatus 100 is removably attached to the grout preparation apparatus 200. In this manner, the grout dispensing apparatus 100 can be positioned on either the left side or the right side of the grout preparation apparatus 200.

The grout preparation apparatus 200 includes a product hopper 204, a grout mixer 208, and a surge hopper 212. In operation, a dry particulate material (e.g., a dry precursor of the groove filling material) is placed in the product hopper 204 until needed. Preferably, the product hopper 204 is large enough to hold a sufficient amount of the dry particulate material to avoid frequent or relatively continual addition of the dry material to the product hopper 204. Preferably, the dry product hopper 204 contains a sight window or a sight tube to allow visual determination of the amount of dry particulate material present in the dry product hopper 204.

The dry particulate material in the product hopper 204 is dispensed into the grout mixer 208 and is mixed with a liquid, preferably water, to produce grout. The amount of water added to the grout mixer 208 is controlled by the amount of dry particulate material added to the grout mixer 208. It should be appreciated that depending on a particular condition one or more additives may also be added, in which case the grout mixer 208 can be operatively connected to an additive inlet (not shown). Preferably, the additive is added separately from the water or the dry particulate material. Exemplary additives added include water reducers, grout retardants and/or grout accelerants. Water reducers reduce the amount of water required to produce the grout, thus maintaining the ultimate set strength of the grout, without decreasing the workability of the grout. Grout retardants increase the amount of time required for the grout to set, and grout accelerants reduce the amount of time required for the grout to set.

Dispensing of the dry particulate material is performed by a mechanical means, such as a pump or an auger. Typically a dry product dispensing auger 216 is used to dispense (or deliver) a relatively precise amount of the dry groove filling material to the grout mixer 208. Preferably, the dry product dispensing auger 216 includes, a dry product feed auger 220, which is located on the bottom of the product hopper 204, and a metering auger 224, which dispenses the dry particulate material to the grout mixer 208. In operation, the meter auger 224 has been found to be very precise in metering a constant and continuous amount of dry material to the grout mixer 208.

The product hopper 204 can include a product hopper vibrator (not shown) for vibrating the product hopper 204. This vibration of the product hopper 204 ensures that substantially all the dry material will fall to the bottom of the product hopper 204, where it is transported to the grout mixer 208 as needed, without too much adhering to the side walls of the product hopper 204. In addition, vibrating the product hopper 204 can also prevent formation of agglomerates.

Under some conditions, such as when a relatively high amount of moisture is present, the dry particulate material may clump, i.e., cake or form agglomerates. This clumping of the dry particulate material is undesirable because it can lead to a non-homogeneous grout. To reduce the amount of caking, the product hopper 204 can include an air pad (not shown) located in the interior of the product hopper 204. The air pad injects air into the product hopper 204. In particular, the air pad injects air into the dry particulate material. Without being bound by any theory, it is believed that the injection of air reduces caking of the material by keeping the particulate material dry. Moreover, the air flow creates a particulate material disturbance which may cause some of the agglomerates to break-up. As stated above, the product hopper vibrator can also provide a constant moving motion to the dry particulate material, thereby reducing the amount of agglomerate formation. The air pad is made of a material having a porous structure to allow air flow into the product hopper 204. However, the pores in the air pad are preferably smaller than the particle size of the dry particulate material to prevent particles from entering the air pad and restricting air flow.

In some cases, the preparation of grout is temperature sensitive. Thus, depending on the ambient temperature, it may be desirable to heat the dry particulate material in order to form a proper grout within the residence time in the grout mixer 208. Therefore, the product hopper 204, the dry product feed auger 220 and/or the metering auger 224 can also include a heating element, i.e., a product heater, (not shown) to preheat the dry particulate material to a desired temperature range. Alternatively, the feed auger 220 and/or the metering auger 224 itself can be heated to heat the dry particulate material. Moreover, the product hopper 204 can further include a temperature sensor (not shown) for determining the temperature of the dry particulate material. Preferably the temperature sensor is located near the transition point from the dry product dispensing device 216 to the grout mixer 208. Preferably, the heating element and the temperature sensor are operatively connected so that the dry particulate material can be heated to predetermined or pre-set temperature range automatically. This automatic heating of the dry particulate material can be achieved by connecting both the heating element and the temperature sensor to a computer or a similar control device.

The dry particulate material which is dispensed from the product hopper 204 into the grout mixer 208 is then mixed with water and, if desired, one or more additives to produce grout. The grout mixer 208 can be any device which can mix a solid material with a liquid to produce grout or other type mixture, such as an auger, a rotatable drum, a stirrer or other similar mechanical devices. Preferably, the grout mixer is an auger capable of maintaining continuous flow of grout to the surge hopper 212.

The grout preparation apparatus 200 can also include a water tank 228 for storing water (or other liquid) which is mixed with the dry particulate material to produce grout. The grout preparation apparatus 200 can also include a water heater (not shown) for heating the water that is supplied to the grout mixer 208. As with heating the dry particulate material when the ambient temperature is low, heating the water that is added to the grout mixer 208 provides a production of grout having desired characteristics. The water heater can be operatively connected to the dry product temperature sensor and/or a grout temperature sensor (not shown) for preheating water depending on the temperature of the dry particulate material and/or the grout. Alternatively, the water tank 228 can also include a separate water temperature sensor (not shown) for determining the water temperature and for controlling the water heater. In other words, the temperatures of the dry material, the water and/or the resulting grout can all be monitored, and the temperatures of the dry material and the water can be controlled by suitable devices to provide a desired grout temperature.

Water is introduced to the grout mixer 208 through a liquid inlet (not shown) located near the introduction point of the dry particulate material. When one or more additives are used in the preparation of grout, the additives can be added separately through an additive inlet (not shown). When the grout mixer is an auger, both the dry particulate material and water are introduced near the initial or inlet portion of the auger. Preferably, the grout mixer 208 is an auger containing a reflux section to increase the residence time of the grout, such as an auger model number LSA40 manufactured by Cemen Tech (Indianola, Iowa). A "reflux section" refers to a portion of the grout mixer 208 where forward motion of the grout toward the surge hopper 212 is substantially reduced and the mixing of the grout is increased. The ratio of water to the dry particulate material is important in making a grout with good physical and chemical properties. The liquid inlet in the grout mixer 208 can include a control valve (not shown) which can be adjusted manually or automatically (e.g., via a computer or other similar control devices) to provide a proper amount of water to the grout mixer 208. Preferably, the control valve provides water to the grout mixer 208 through the liquid inlet to within 5% accuracy, preferably within about 2% accuracy, and more preferably within about 0.5% accuracy. As the auger (i.e., the grout mixer 208) mixes the dry particulate material, water and additives (if desired or necessary) to produce grout, the grout travels from one end of the grout mixer 208 to the other. The auger can also provide a shearing action which facilitates mixing of the dry particulate material and water. The auger can also provide the action necessary to activate any additive (e.g., polymers) which may be added separately or are present in the dry particulate material. Use of polymers in a grout preparation is discussed in detail below. Although only one product hopper 204 is shown in the figures, it will be appreciated that if separate additives are used, an additive hopper (not shown) may also be present to dispense such additives to the grout mixer 208. The grout is then dispensed from the grout mixer 208 and is placed into the surge hopper 212.

The grout preparation apparatus 200 can also include a grout temperature sensor (not shown) for determining the temperature of the grout and controlling the addition of additives to the grout mixer 208. Moreover, the grout temperature sensor can also be operatively connected to other devices such as the dry product heater and/or the water heater. Typically, the grout temperature sensor determines the temperature of the grout in the surge hopper 212.

During the start of operation of the grout preparation apparatus 200, it may be necessary to adjust the flow rate of water and/or the dry particulate material to produce grout having a proper physical characteristics such as consistency, flowability, etc. and proper chemical characteristic, such as setting time, etc. To prevent grout having undesired physical or chemical characteristics from being placed into the surge hopper 212, the grout mixer 208 is preferably designed to be movable so that it can be moved, e.g., swung, away from the surge hopper 212. In this manner, at the start of the operation, the grout mixer 208 is swung away from the surge hopper and the flow rate of water, the flow rate of the dry particulate material (and any additives), the temperature of water and/or the temperature of the dry particulate material are adjusted until the grout having desired characteristics is produced, at which time the grout mixer 208 is placed in position such that the grout in the grout mixer 208 is dispensed into the surge hopper 212.

In order to prevent the grout in the surge hopper 212 from setting, the surge hopper 212 can include a surge hopper grout agitator 232. The grout agitator 232 stirs the grout in the surge hopper 212 to maintain homogeneity of the grout. Any device that stirs the grout can be used as a surge hopper grout agitator 232 including an auger, a stirrer and a rotating drum where the surge hopper itself rotates to agitate the grout. Preferably, the surge hopper grout agitator 232 is a mechanical stirrer.

The rate of grout production depends on the rate of grout use for a particular application. For example, in a pavement lane marking operation where a total of about 20 meters in length of about 10 cm wide and about 0.6 cm deep groove is filled per minute, the grout mixer 208 is generally operated at a rate of from about 5 liter (L) per minute (L/min) to about 20 L/min of grout production, more preferably from about 10 L/min to about 17 L/min, and most preferably at about 15 L/min. While it may be possible that the rate of grout use can be higher than the rate of grout production for limited periods of time, typically the rate of grout production is equal to or higher than the rate of grout use. When the rate of production is greater than the rate of use, the amount of grout in the surge hopper 212 will increase. One way of preventing the grout in the surge hopper 212 from overflowing is to manually turn off the grout mixer 208. This requires constant monitoring or the grout level by the operator. While manually turning the grout mixer 208 on and off can be used to prevent the grout overflow in the surge hopper 212, it is preferred that the grout production be controlled automatically, e.g., based on the grout level in the surge hopper 212. This automation of the grout production reduces the probability of having too much or too little grout in the surge hopper 212.

One method of controlling the rate of grout production is to include a surge hopper grout level sensor (not shown). Exemplary sensors useful in determining the grout level in the surge hopper 212 include optical sensors, acoustic sensors, electromagnetic wave sensors, mechanical sensors, and electrical sensors. Preferably, the surge hopper grout level sensor is an ultrasonic sensor. An example of an ultrasonic sensor which is useful in sensing the grout level is a sonic sensor Model No. S0N51K manufactured by Vega Grieshaber KG (SchiTach, Germany). The surge hopper grout level sensor is operatively connected to the grout mixer 208 and controls the grout mixer 208. Preferably, the surge hopper grout level sensor is also operatively connected to and controls the dry product vibrator and the dry product dispensing device 216. Thus, when the surge hopper grout level sensor detects that the grout level in the surge hopper 212 is below a particular level it turns on the product hopper vibrator, the dry product dispensing device 216, the grout mixer 208, the liquid inlet and other devices which may be present and required (see below) to produce more grout. When the surge hopper grout level sensor detects that the grout level in the surge hopper 212 is above a certain level it can turn-off the product hopper vibrator, the dry product dispensing device 216 and the grout mixer 208. In addition other devices which may be present and operating, such as the dry product vibrator, the air pad, the water inlet, and/or the liquid additive inlet, can also be turned-off by the control system which is operatively connected to the surge hopper grout level sensor. Preferably, there is a delay in turning off the grout mixer 208 relative to all other devices such that substantially all the grout in the grout mixer 208 is dispensed from the grout mixer 208. The delay time for turning off the grout mixer 208 is at least as long as the residence time of the grout in the grout mixer 208, which is typically about 2 minutes. Preferably the delay time is at least about 10 seconds longer than the average residence time of the grout in the grout mixer 208, more preferably at least about 20 seconds longer than the average residence time of the grout in the grout mixer 208, and most preferably at least about 30 seconds longer than the average residence time of the grout in the grout mixer 208.

Another embodiment of the present invention provides a grout dispensing apparatus 100 which can be used alone or be operatively connected to the grout preparation apparatus 200 described above. When the grout dispensing apparatus 100 is used in conjunction with the grout preparation apparatus 200, the grout preparation apparatus can also include a grout dispensing device (not shown) which dispenses grout from the surge hopper 212. Exemplary grout dispensing devices include augers, slurry pumps, conveyors and gravity slide type devices. In a particular embodiment of the present invention, the grout dispensing device is a peristaltic pump which dispenses grout from the surge hopper 212 through a hose. Preferably the hose can be moved from one side of the grout preparation apparatus 200 to the other side of the grout preparation apparatus 200 to allow positioning of the grout dispensing apparatus 100 on either side of the grout preparation apparatus 200. In addition, the hose may be connected to a sprayer device (not shown) for a spray-on application of the grout. In this manner the grout can be simply sprayed onto a pavement surface. The sprayed embodiment is especially useful on asphalt. Although a sprayed mark does not last as long as grout applied to a pavement groove, it can last about three years or more. This useful life is about three times as long as paint, and is about the same length as the useful life of asphalt.

The grout dispensing apparatus 100 includes a grout hopper 104, a side form 108, and a material gate 112. The grout hopper 104 is operatively connected to a material gate 112 which has open and closed positions. Opening and closing of the material gate 112 can be achieved manually or by a mechanical device, such as a hydraulic device, a gear device, a motor, a belt or a chain driven device, and other suitable devices. In a particular embodiment of the present invention, opening and closing of the material gate 112 is achieved by a hydraulic device 114. In operation, grout is placed in the grout hopper 104 and the grout dispensing apparatus 100 is placed near a pavement groove and the side form 108 is inserted into the pavement groove. For a pavement lane marking, the side form 108 is typically from about 10 cm to about 35 cm in length, preferably from about 15 cm to about 30 cm in length, and more preferably from about 20 cm to about 25 cm in length. Preferably, the grout dispensing apparatus 100 has two side forms, one for each side boundary (i.e., side-walls) of the pavement groove. The side forms 108 are designed to be inserted into the pavement groove such that they are substantially near the side boundaries of the pavement groove and fit relatively snugly against the side-walls of the pavement groove. In this manner, the grout is confined to the width of the pavement groove without spilling over onto the adjacent pavement surface. The side forms 108 can be moved vertically, for example, by a spring-load mechanism, to allow adjustment to various pavement groove depths. Although the side form 108 can be a variety of shapes, preferably the side form 108 is rectangular or a trapezoid-like shape. The distance between the two side forms 108 is generally substantially equal to, but slightly less than, the width of the pavement groove. While grout dispensing apparatus having a particular distance between the side forms 108 is generally used for a given pavement groove width, the width of the grout dispensing apparatus 100 may be designed to be adjustable such that it can be used in a variety of pavement groove widths.

Preferably, the side forms 108 are guillotine-like, i.e., the side forms 108 move vertically using a spring-loaded mechanism, allowing the side forms 108 to be in a constant contact with the pavement groove bottom surface. Since the side forms 108 contact the grout, the side forms 108 are designed to prevent the grout from adhering, i.e., sticking, and setting on the side forms 108. There are many ways to prevent the grout from sticking and setting on the side forms 108, including coating the side forms 108 with non-sticking materials such as non-sticking ceramic materials, using mechanical devices, such as scrapers, and using pressurized air spray devices. In a particular embodiment of the present invention, a constant stream of pressurized air on both sides of each of the side forms 108 is used to maintain free vertical movement of the side forms 108.

The pavement groove can be prepared by any suitable method, including using a plurality of saw blades. One apparatus for generating a pavement groove is disclosed in U.S. Pat. No. 5,857,453, entitled "Precision Slot Cutting Machine for Concrete and Asphalt," issued to Caven et al., which is incorporated herein by reference in its entirety. Briefly, the cutting machine includes a plurality of saw blades. The number of saw blades in the cutting machine is determined by the desired width of the pavement groove to be generated. Saw blades are spaced apart in a manner consistent with the desired texture of the bottom surface of the pavement groove. A wide spacing of saw blades generally creates a relatively rougher texture, and a narrow spacing of saw blades creates a relatively smoother texture. Moreover, the spacing of saw blades creates a groove with a corduroy-like textured bottom surface. A corduroy-like textured bottom surface of a groove provides larger surface area which allows for stronger bonding between the pavement groove and the grout.

Prior to filling the pavement groove with grout, it is important that the pavement groove be properly prepared so that a strong and proper bonding occurs between the pavement groove and the grout. For example, the pavement groove should be substantially free of all loose debris or particles which may prevent a direct formation of bonding between the pavement groove and the grout. To ensure the pavement groove is substantially free of all loose particles, the grout dispensing apparatus 100 can include a groove clearing air spray device 116. The air pressure of the groove clearing air spray device should be sufficiently high enough to remove substantially all loose particles. To remove substantially all relevant particles, an air flow of from about 850 L/min to about 2150 L/min can be used, preferably an air flow of from about 1100 L/min to about 1850 L/min is used, and more preferably an air flow of from about 1400 L/min to about 1700 L/min is used. Generally, the air flow in the air spray device 116 is independent of the speed of the grout dispensing apparatus 100 as long as the air flow is sufficiently high enough to remove substantially all loose particles.

A presence of moisture in the pavement groove provides a strong bonding between the pavement groove and the grout. Therefore, the grout dispensing apparatus 100 can also include an operatively connected mist spray device 120 for spraying water mist into the pavement groove. Formation of a strong and proper bond between the grout and the pavement groove requires a relatively narrow range of the pavement groove moisture content. Too much or too little moisture in the pavement groove is detrimental to a strong bonding between the pavement groove and the grout. Since the amount of water applied to the pavement groove depends on the rate of water sprayed by the mist spray device 120 (e.g., spray nozzle) and the speed at which the mist spray device moves along the pavement groove, it is preferred that the rate of water spray be connected to the forward travel speed of the grout dispensing apparatus 100 as it moves along the pavement groove. In this manner, a relatively constant amount of water mist is applied to each area of the pavement groove.

After positioning the grout dispensing apparatus 100 near the pavement groove and inserting the side forms 108 in the pavement groove, the material gate 112 is opened to dispense the grout in the grout hopper 104 into the pavement groove. The grout dispensing apparatus 100 is then moved along the length of the pavement groove until the pavement groove has been filled with the grout. As the grout dispensing apparatus 100 moves along the pavement groove, the extruded grout fills the pavement groove, is struck off by the strike-off 124 and is leveled to the adjacent pavement surface level by the extrusion pan 128.

The grout hopper 104 can include a grout hopper vibrator (not shown) for vibrating the grout hopper. The vibration of the grout hopper allows a smooth flow of the grout from the grout hopper into the pavement groove. In addition, the vibration of the grout hopper reduces the amount of grout which adheres to the side of the grout hopper.

The grout hopper 104 can also include a grout hopper grout agitator 132. The agitator 132 agitates (or stirs) the grout in the grout hopper 104 to maintain homogeneity of the grout and prevent the grout from setting. The agitator 132 can be a single unit or it can have an agitator motor 136 which is removably attached to the agitator shaft 140 by a belt, a chain, a gear or other drive devices 144. Preferably, the agitator 132 contains a grout-hopper side wall wiping device (not shown) to ensure agitation of all the grout in the grout hopper 104.

The grout hopper 104 can also include a grout hopper grout level sensor (not shown). The sensor determines the amount of grout in the grout hopper 104 and controls a device which dispenses the grout into the grout hopper. The grout hopper grout level sensor can be any of the grout level sensors similar to those discussed above for the surge hopper grout level sensor. It should be appreciated that when the grout dispensing apparatus 100 is used alone, there is no need for the grout hopper grout level sensor. However, when the grout dispensing apparatus 100 is connected to a grout preparation apparatus 200 such as the one discussed above, the grout hopper grout level sensor can be operatively connected to the grout dispensing device (not shown) which is disclosed above. In this manner, the amount of grout in the grout hopper 104 can be adjusted automatically so that there is a sufficient amount of grout in the grout hopper 104 when needed. In a particular embodiment of the present invention, the grout hopper grout level sensor is an optical sensor, specifically an analog photoelectric sensor model number E3SA manufactured by Omron Corporation (Tokyo, Japan).

The material gate 112 is generally located on the bottom of the grout hopper 104 so that when the material gate 112 is in an open position the grout flows into the pavement groove. Opening and closing of the material gate 112 can be controlled by a hydraulic means or any other method of opening and closing such a device. The material gate 112 can be manually controlled. Alternatively, the material gate 112 can be controlled automatically by connecting it to a pavement groove sensor (not shown) which detects the presence of a pavement groove near the material gate 112.

As discussed above, the grout dispensing apparatus 100 preferably contains two side forms 108 with the distance between the side forms 108 being substantially equal to the width of the pavement groove. The side forms 108 fit within the pavement groove substantially on the side boundaries of the pavement groove. As the grout is filled in the pavement groove the side forms 108 confine the grout within the pavement groove. Additionally, the side forms 108 help to position the material gate 112 directly over the pavement groove.

As the grout dispensing apparatus 100 travels along the length of the pavement groove, the strike-off 124 limits the amount of the grout flow into the pavement groove to the adjacent pavement surface level and the extrusion pan 128 levels the grout that has been placed in the pavement groove. The extrusion pan 128 can be a bar of any suitable shape or a plate which levels the grout to the adjacent pavement surface level. Preferably, the difference between the height of the adjacent pavement surface and the leveled grout is less than 1.5 mm, more preferably less than about 0.8 mm, and most preferably less than about 0.4 mm.

The grout dispensing apparatus 100 can also include a smoothing plate 148 to smooth out the surface of the grout that has been filled and leveled in the pavement groove. The smoothing plate 148 can be any suitable shape. The grout dispensing apparatus 100 of the present invention can also include a smoothing plate vibrator (not shown) for vibrating the smoothing plate. Typically, the smoothing plate vibrator is a pencil vibrator or a similar device. The amplitude of vibration is less than about 1 mm, preferably less than about 0.5 mm, and more preferably less than about 0.1 mm. The frequency of vibration may be adjusted as is necessary to produce a smooth leveled grout in the pavement groove. The vibration of the smoothing plate 148 trowels the grout and pushes the grout against the side wall of the groove, thereby reducing or eliminating any channel that is formed due to the side forms 108. In addition, the vibration of the smoothing plate 148 seals the surface of the grout to provide desired performance qualities.

The grout dispensing apparatus 100 can also include a rollable support system 152 such as wheels, tracks and/or skids for moving the grout dispensing apparatus 100 easily along the pavement surface. Preferably, the rollable support system 152 includes a suspension system 156 to minimize the variation of the grout level due to irregularities present in the pavement surface. Preferably, the suspension system 156 is a longitudinal bogey averaging system and a transversal bogey averaging system, which averages the irregularities in the adjacent pavement surface. The bogey averaging system allows the level of grout placed into the pavement groove to be within about 1.5 mm relative to the adjacent pavement surface, more preferably within about 0.8 mm, and most preferably within about 0.4 mm.

As mentioned below, a visibility-enhancing agent (e.g., a reflective agent) can be an integral mixture of the grout. Alternatively, the visibility-enhancing agent can be embedded in the grout surface in a separate step before the grout is completely cured. To allow a separate step of embedding the visibility-enhancing agent to an uncured grout, the grout dispensing apparatus 100 of the present invention can have an operatively connected visibility-enhancing agent applying device 160. Alternatively, the visibility-enhancing agent can be placed on the uncured grout surface separately. Preferably, the particle size of visibility-enhancing agent is at least about 600 microns and more preferably at least about 850 microns. For such a small particle size, it is preferred that the visibility-enhancing agent be embedded on the grout surface by a visibility-enhancing agent applying device 160. When the visibility-enhancing agent is applied to the grout surface, preferably from about 25% to about 75% of the visibility-enhancing agent is embedded in the grout surface, more preferably from about 33% to about 66% of the visibility-enhancing agent is embedded in the grout surface, and most preferably at least about 50% of the visibility-enhancing agent is embedded in the grout surface. The visibility-enhancing agent applying device 160 can be a spray nozzle, a simple gravity utilizing spreader or a dropper, or any other devices which can apply and embed the visibility-enhancing agent as prescribed above. When the visibility-enhancing agent applying device 160 is operatively connected to the grout dispensing apparatus 100, it is preferred that a warning device (not shown), such as an indicator (e.g., a light) or an alarm, be present to alert the operator if the visibility-enhancing agent is not being properly applied or dispensed by the visibility-enhancing agent applying device 160.

The grout dispensing apparatus 100 of the present invention can also include an operatively connected grout-surface air spray device 164 for further embedding and/or removing non-embedded visibility-enhancing agent from the grout surface in the pavement groove. Preferably the grout-surface air spray device 164 is an air spray nozzle which produces a sufficient air spray pressure to substantially remove all non-embedded visibility-enhancing agents and to further embed the visibility-enhancing agents without substantially affecting the grout surface. If the air spray pressure is too high, it may disturb or cause an indentation in the grout surface. Preferably, the pressure of air in the air spray nozzle is adjustable so that the operator can change the air pressure depending on particular conditions.

The newly poured grout is subject to a variety of environmental conditions, such as rain, snow, heat and dust. To allow the grout to cure properly, one can coat the newly poured grout with a protective coating. Thus, the grout dispensing apparatus 100 of the present invention can also include an operatively connected curing-agent (or sealing-agent) applying device 168 for applying a curing-agent (or sealing-agent) on the grout. The curing-agent applying device 168 can be any device for applying a curing-agent on the grout surface. Preferably, the curing-agent applying device 168 sprays the curing agent on top of the grout and/or the visibility-enhancing agent using a spray nozzle. Sealing the grout and/or the visibility-enhancing agent protects it from environment and allows the grout to cure properly.

When the operations of the grout dispensing apparatus 100 (i.e., opening of the material gate 112) the visibility-enhancing agent applying device 160, the grout-surface air spray device 164, and/or the curing-agent applying device 168 are controlled by a single device (e.g., a switch), there should be a sufficient delay in starting the operation of the visibility-enhancing agent applying device 160, the grout-surface air spray device 164, and/or the curing-agent applying device 168 relative to the starting time of the operation of the grout dispensing apparatus 100 to allow for the time required for the visibility-enhancing agent applying device 160, the grout-surface air spray device 164, and/or the curing-agent applying device 168 to be in position over the grout in the pavement groove. Similarly, there should be a delay time for turning off the visibility-enhancing agent applying device 160, the grout-surface air spray device 164, and/or the curing-agent applying device 168 relative to the operation of the grout dispensing apparatus 100 to allow the visibility-enhancing agent applying device 160, the grout-surface air spray device 164, and/or the curing-agent applying device 168 to cover the last few centimeters of the grout that is dispensed into the pavement groove.

Another embodiment of the present invention provides a self-propulsion device 300, which can be operatively connected to the grout preparation apparatus 200 and/or the grout dispensing apparatus 100 discussed above. When the grout dispensing apparatus 100 is connected to the self-propulsion device 300 (or the grout preparation apparatus 200), a grout dispensing apparatus lifting device (not shown) can also be included for lifting the grout dispensing apparatus 100 above the pavement surface, for example, when it is not in use. Such lifting device can be a hydraulic device, a pneumatic device, an electrical device, and/or a mechanical device. Moreover, vertical and axial movements of the grout dispensing apparatus 100 is independent of the self propulsion device 300. This independent movement allows the grout dispensing apparatus 100 to adapt to the contours on or near the pavement groove independent of the contours experienced by the self-propulsion device 300.

The self-propulsion device 300 (or the grout preparation apparatus 200) can also include a guiding device (not shown) for guiding the grout dispensing apparatus 100 into a proper position to fill the pavement groove. In operation, the operator lowers the grout dispensing apparatus 100 onto the pavement surface such that the pavement groove is within the lateral movement leeway of the grout dispensing apparatus 100 (discussed below) and positions the grout dispensing apparatus 100 into a proper position for filling the pavement groove using the guiding device.

The self-propulsion device 300 includes a self-propulsion system for self-propulsion (not shown), a control panel 304, and a swing arm 308. The self-propulsion system can be an electric engine, such as a solar-powered engine and/or other battery operated engines; a combustion engine, which uses diesel, gasoline, natural gas, an alcohol or other fuel; or a combination thereof. Other type engines can be used. These self-propulsion systems are generally known to one skilled in the engine art. The speed of travel of the self-propulsion device 300 can be controlled by a variety of means, including by using a pedal, a variable resistor and other known methods. However, because a constant and/or a fine control of a pedal is relatively difficult, it is preferred that the speed control device (not shown) of the self-propulsion device 300 is a variable resistor type control such as a knob, a lever or any other suitable set control devices, more preferably the speed control device is a variable resistor knob (i.e., a dial). In this manner, the speed of travel can be controlled by turning, setting or positioning the variable resistor to a particular position. This provides a constant and repeatable speed of travel.

The control panel 304 of the self-propulsion device 300 is attached to the swing arm 308 which allows the control panel 304 to be positioned on either the left side or the right side of the self-propulsion device 300. The control panel 304 includes a variety of controls (not shown) which control the operations of the self-propulsion device 300 and any other apparatus which may be operatively connected to the self-propulsion device 300.

The control panel 304 also can include a steering mechanism (not shown) for controlling the direction of travel of the self-propulsion device 300. The self-propulsion device 300 of the present invention preferably contains only one steering device because the control panel 304 is attached to the swing arm 308, which allows the steering device to be placed on the left side or the right side. Thus, there is no need for a second steering mechanism on the self-propulsion device 300.

The self-propulsion device 300 can also include other attendant devices, such as a fuel tank, hydraulics, air compressors or other pressure generators, pressurized cleaner for cleaning any of the above described devices and other useful devices.

The above described apparatus can be used alone or in any combination. Moreover, devices which are not manually controlled, such as surge hopper grout agitator and grout hopper grout agitator, have on, off and auto settings. These devices are typically set to the auto position during operation. The on position of these individual devices are generally used during maintenance or cleaning operations. In addition, to prevent the grout from adhering and setting on any of the devices which contacts the grout, these devices can be coated, e.g., sprayed-on, with a non-sticking material, such as non-sticking ceramic materials.

In a particular embodiment of the present invention, the pavement groove filling apparatus 10 is a self-propulsion pavement groove filling apparatus, where the control panel 304 includes a forward speed control device (e.g., a switch). The forward speed control device (not shown) has at least three settings: pave, skip and stop modes. When the forward speed control device is in the pave mode, the groove clearing air spray device 116 and the mist spray device 120 are turned on, and the self-propulsion pavement groove filling apparatus accelerates to pave speed that is set by the variable speed control device. When the forward speed control is in the stop or the skip mode, the groove clearing air spray device 116, the mist spray device 120, the visibility-enhancing agent applying device 160, the grout surface air spray device 164 and the curing agent applying device 168 are turned off. In addition, the material gate 112 is closed to prevent flow of grout out of the grout hopper 104. However, in the stop mode, the self-propulsion pavement groove filling apparatus stops any forward motion, where as in the skip mode the self-propulsion pavement groove filling apparatus accelerates to travel speed that is set by the variable speed control device.

The control panel 304 can also include a temperature control switch (not shown). When the temperature control switch is in the "on" position, temperatures of the dry particulate material, water and the grout are determined by corresponding temperature sensors. A computer or other similar control devices then controls the dry product heater and the water heater to heat the dry particulate material and/or the water, if necessary. In a particular embodiment of the present invention, both of the heaters are operatively connected to the dry product and the grout temperature sensors. In addition, depending on the grout temperature, an additive may also be added to the grout mixer 208.

A grout useful with the present invention has good flexural strength, excellent bonding ability, good workability characteristics, excellent abrasion resistance, and/or excellent retro-reflectivity. There are many type of grouts including grouts for cold temperature use and grouts for hot temperature use. In the present invention, grout having an optimum temperature of use of about 21° C. is preferred. A useful grout is disclosed in provisional U.S. patent application Ser. No. 60/083,960, entitled "Integrated Marking Materials" by Sandra Sprouts, filed on May 1, 1998, and in corresponding U.S. patent application Ser. No. 09/299,536 entitled "Integrated Marking Materials" by Sandra Sprouts, filed on Apr. 1, 1999, both of which are incorporated herein by reference in their entirety. The cementitious mixture (i.e., grout) can include a cementitious binder. In a dry formulation, the cementitious binder is a hydraulic cement, preferably a portland cement or quick setting cementitious binder such as magnesium phosphate or magnesium potassium phosphate cement, or any other suitable hydraulic binder.

The grout can also include a variety of polymers to provide a range of desired physical properties. For example, a grout can include a polymeric cement modifier such as a polymeric resin. Exemplary polymeric resins include, but are not limited to, resins of acrylic, ethylene vinyl acetate, styrene-acrylic, styrene-butadiene, polyvinyl acetate, vinyl versatate, vinyl acetate, and blends, copolymers, or terpolymer of these resins. The amount of polymeric cement modifier used should be sufficient to compatablize the cementitious material with other material which may be present in the dry particulate material such as the retroreflective and reflective fillers, but it should not unfavorably diminish the strength of the resulting material.

The dry particulate material can also contain other customary components of cementitious mixtures, such as aggregate, including fine aggregate or sand, and coarse aggregate, such as silica, quartz, crushed rounded marble, glass spheres, granite, limestone, calcite, feldspar, alluvial sands, other durable aggregate, mixtures of aggregate and the like.

The dry particulate material can also contain a variety of useful modifiers to control set time, enhance binding of the grout to the groove, control shrinkage, enhance the strength of the grout, or other desired modifiers. Such modifiers include, but are not limited to, a dispersant, a plasticizer, a water reducer, and/or one or more other common admixtures as needed for the particular application and environment, such as an accelerator; an air entrainer; a defoamer; fibers; an inert filler, such as calcium carbonate, ceramic microspheres, mica, talc, silica flour, diatomaceous earth, rice husk ash and the like; a natural clay; a pozzolanic filler, such as fly ash, kaolin, silica fume, blast furnace slag and the like; a retarder; a rheology modifier, such as a water soluble polymer; a shrinkage compensating agent; a synthetic clay; a suspending agent; a thickening agent; and the like; and mixtures thereof. Suitable examples of these admixtures are known to those skilled in the art, and representative examples are listed in U.S. Pat. No. 5,728,209, which is incorporated by reference herein in its entirety.

The dry particulate material can also include a coloring agent such as an inorganic pigment, an organic pigment and/or an inorganic/organic hybrid pigment, including any suitable dye or colorant. Such pigments include but are not limited to, carbon black, white latex, Hansa yellow (2-[4-methoxy-2-nitrophenyl)azo]N-(2-methoxyphenyl)-3-oxo butanamide), iron oxide, titanium dioxide, zinc sulfate, zinc sulfides, LumiNova™, modified zinc sulfide (United Minerals Corp.), Lithopone zinc sulfide/barium sulfate, zinc oxide, titanates, nickel antimony titanates, phthalocyanines, mixed phase spinels and oxides, and mixtures thereof. The dry particulate material can be tailored in color and consistency to meet specific aesthetic and/or design needs.

To enhance visibility at night or in other low light conditions, the dry particulate material can also include a visibility-enhancing agent such as retroreflective and/or reflective agents. Exemplary visibility-enhancing agents include, but are not limited to, glass beads, glass bubbles, glass spheres, ceramic spheres, plastic beads, and the like, and mixtures thereof. A visibility-enhancing agent can be placed as a top-coat or broadcast layer for initial surface reflection characteristics. As discussed in detail below, a visibility-enhancing agent can also be included integrally in the grout so that its visibility-enhancing property remains after the visibility-enhancing agents on the surface of the pavement are worn off. The size of the visibility-enhancing agent is selected to achieve the best combination of retroreflectivity and/or reflectivity and wear characteristics for a particular pavement marking. Preferably, the average top size of the visibility-enhancing agent is at least about 600 microns ($\mu$m), and more preferably at least about 850 $\mu$m. It should be appreciated that the average top size of the visibility-enhancing agent is limited only by availability and ease of incorporation into and mixing with the other components of the grout or its ability to be embedded into the top surface of the grout.

A typical operation of the self-propulsion pavement groove filling apparatus is illustrated as follows. An operator positions the grout dispensing apparatus 100 and the control panel 304 on an appropriate side of the self-propulsion device 300 for a given construction application. The dry particulate material is placed into the product hopper 204 and is heated to desired temperature based on the temperature determined by the product temperature sensor and the grout temperature sensor. The dry product dispensing device 216, which is controlled by the surge hopper grout level sensor, meters the dry particulate material from the product hopper 204 to the grout mixer 208. Water is injected into the grout mixer 208 through a liquid inlet. The injection of water is also controlled by the surge hopper grout level sensor. However, the rate of the amount of water added is controlled manually. Preheating of water is based on the temperature of the dry particulate material and the temperature of the grout as determined by the dry product and the grout temperature sensors. Additives, if needed, are also added into the grout mixer 208 based on the grout temperature as determined by the grout temperature sensor. The rate of additive addition (typically in mL/hr) to the grout mixer 208 is typically controlled manually. Preferably, there is a warning device, similar to those discussed above for the visibility-enhancing agent applying device 160, which alerts the operator when the additive inlet is open but there is insufficient amount of additives being added to the grout mixer 208.

The grout mixer 208 mixes the materials to homogeneous consistency and transfers the resulting grout to the surge hopper 212. The surge hopper grout agitator, which is manually controlled, agitates grout in the surge hopper 212 to maintain homogeneity of the grout.

The grout dispensing device, which is controlled by the grout hopper grout level sensor, dispenses grout from the surge hopper 212 to the grout hopper 104 through a grout transfer hose. The grout hopper grout agitator 132 agitates the grout in the grout hopper 104 to maintain homogeneity of the grout.

The operator steers the self-propulsion device 300 using the steering device to within about 30 cm range of the pavement groove using a sighting mechanism. The grout dispensing apparatus 100 has from about 10 cm to about 50 cm, preferably about 30 cm, of lateral movement leeway independent from the self-propulsion device 300 to allow the operator to position the grout dispensing apparatus 100 over the pavement groove independently of the position of the self-propulsion device 300. The grout dispensing apparatus 100 is then positioned near the pavement groove such that the side forms 108 are inserted into the pavement groove.

The material gate 112 is opened to allow flow of the grout from the grout hopper 104 into the pavement groove. The operator starts forward motion by selecting the pave mode from the control panel 304, which automatically turns on the groove clearing air spray device 116 and the mist spray device 120. The groove clearing air spray device 116 directs compressed air into the pavement groove ahead of the grout dispensing apparatus 100 to clear the pavement groove of debris. Compressed air is at a constant pressure regardless of the forward travel speed of the self-propulsion device 300. The mist spray device 120 applies a mist of water into the pavement groove in front of the grout dispensing apparatus 100. Pressure of the water mist application is dependent on the forward travel speed of the self-propulsion device 300.

Simultaneously, the self-propulsion device 300 moves forward at travel speed, which is selected by the operator. Grout is placed into the pavement groove, is confined to the pavement groove by the side forms 108, is struck off by the strike-off 124, leveled by the extrusion pan 128 and smoothed by the smoothing plate 148.

The visibility-enhancing agent applying device 160 applies reflective beads onto the surface of the wet grout. The application of the beads is started upon start of pave mode with about three seconds delay, and the application of the beads is stopped about three seconds after the pave mode is turned off.

The grout surface air spray device 164 sprays compressed air onto the grout surface to flush away any excess beads that are not embedded and to further embed the beads into the grout surface. The spray of compressed air is started upon start of pave mode with about three seconds delay and is stopped about three seconds after the pave mode is turned off.

The curing-agent applying device 168 then sprays a grout curing agent on the grout surface. The pressure of curing agent spray is dependent on the speed of the self-propulsion device to reduce or eliminate pooling of the curing agent. Spraying of the curing agent is started upon start of pave mode with about three seconds delay and is stopped about three seconds after the pave is turned off.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

10 Pavement groove filling apparatus
100 grout dispensing apparatus
104 grout hopper
108 side forms
112 material gate
114 hydraulic device
116 groove clearing air spray device
120 mist spray device
124 strike-off
128 extrusion pan
132 grout hopper grout agitator
136 agitator motor
140 agitator shaft
144 belt, chain, gear or other drive devices
148 smoothing plate
152 roller support system
156 suspension system
160 visibility enhancing agent applying device
164 grout surface air spray device
168 curing agent applying device
200 grout preparation apparatus
204 product hopper
208 grout mixer
212 surge hopper
216 dry product dispensing device
220 dry product feed auger
224 metering auger
228 water tank
232 surge hopper grout agitator
300 self-propulsion device
304 control panel
308 swing arm

What is claimed is:

1. A grout dispensing apparatus comprising:

(a) a grout hopper for storing, grout;

(b) a material gate having open and closed positions operatively connected to said grout hopper for dispensing the grout from said grout hopper into a pavement groove when said material gate is in the open position;

(c) a side form for confining the grout substantially within side boundaries of the pavement groove:

(d) an extrusion pan for leveling the grout in the pavement groove;

(e) a visibility-enhancing agent applying device for applying and embedding a visibility-enhancing agent on the grout surface in the pavement groove; and (f) a warning device operatively connected to said visibility-enhancing agent applying device for alerting the operator when the visibility-enhancing agent is not being properly applied or dispensed by the visibility-enhancing agent applying device.

2. A grout dispensing apparatus comprising:

(a) a grout hopper for storing grout;

(b) a material gate having open and closed positions operatively connected to said grout hopper for dispensing the grout from said grout hopper into a pavement groove when said material Rate is in the open position;

(c) a side form for confining the grout substantially within side boundaries of the pavement groove;

(d) an extrusion pan for leveling the trout in the pavement groove;

(e) a visibility-enhancing agent applying device for applying and embedding a visibility-enhancing agent on the grout surface in the pavement groove; and (f) a grout-surface air spray device for removing non-embedded visibility-enhancing agent from the grout surface and for further embedding the visibility-enhancing agent into the grout surface.

3. A grout dispensing apparatus comprising:

(a) a grout hopper for storing grout;

a material gate having open and closed positions operatively connected to said grout hopper for dispensing the grout from said grout hopper into a pavement groove when said material gate is in the open position;

(c) a side form for confining the grout substantially within side boundaries of the pavement groove;

(d) an extrusion pan for leveling the grout in the pavement groove; and (e) a rollable support system;

wherein said rollable support system comprises a longitudinal bogey averaging system and a transversal bogey averaging system.

4. A grout dispensing apparatus comprising:

(a) a grout hopper for storing grout;

(b) a material gate having open and closed positions operatively connected to said grout hopper for dispensing the grout from said grout hopper into a pavement groove when said material gate is in the open position;

(c) a side form for confining the grout substantially within side boundaries of the pavement groove;

(d) an extrusion pan for leveling the grout in the pavement groove; and (e) a groove clearing air spray device for clearing the pavement groove of particles.

5. The grout dispensing apparatus of claim 4, further comprising a mist spray device for spraying water mist into the pavement groove.

6. A grout dispensing apparatus comprising:

(a) a grout hopper for storing grout;

(b) a material gate having open and closed positions operatively connected to said grout hopper for dispensing the grout from said grout hopper into a pavement groove when said material gate is in the open position;

(c) a side form for confining the grout substantially within side boundaries of the pavement groove; and (d) an extrusion pan for leveling the grout in the pavement groove;

further comprising a grout preparation apparatus operatively connected to said grout dispensing apparatus, wherein said grout preparation apparatus comprises:

(a) a product hopper for storing a dry particulate material;

(b) a product dispensing device for dispensing at least a portion of the dry particulate material from said product hopper;

(c) a grout mixer operatively connected to said product-dispensing device for mixing the dry particulate material with water to produce the grout;

(d) a surge hopper operatively connected to said grout mixer for storing the grout; and (e) a surge hopper grout agitator for agitating the grout in said surge hopper.

7. The grout dispensing apparatus of claim 6, further comprising a grout temperature sensor for determining the temperatures of the grout in said surge hopper.

8. The grout dispensing apparatus of claim 7, further comprising a dry product temperature sensor for determining the temperatures of the dry particulate material, and a product heater operatively connected to said product temperature sensor and said grout temperature sensor for heating the dry particulate material.

9. The grout dispensing apparatus of claim 6, wherein said grout preparation apparatus further comprises a water storage device operatively connected to said grout mixer for storing water, and wherein said grout mixer comprises a water inlet operatively connected to said water storage device for supplying water to said grout mixer.

10. The grout dispensing apparatus of claim 9, where in s aid grout preparation apparatus further comprises a water temperature sensor for determining the temperature of water in said water storage device, and a water heater operatively connected to said water temperature sensor and to said grout temperature sensor for heating water.

11. The grout dispensing apparatus of claim 7, wherein said grout mixer further comprises an additive inlet for adding an additive to said grout mixer, and wherein the addition of the additive is operatively connected to said grout temperature sensor.

12. The grout dispensing apparatus of claim 6, wherein said product hopper further comprises a product hopper vibrator for vibrating said product hopper and an air pad for injecting air into said product hopper.

13. The grout dispensing apparatus of claim 6, further comprising a surge-hopper grout level sensor, wherein said surge-hopper grout level sensor is operatively connected to said grout mixer and said product dispensing device for controlling the production of grout.

14. The grout dispensing apparatus of claim 6, wherein said grout preparation apparatus further comprises a grout dispensing device for dispensing the grout from said surge hopper to said grout hopper.

15. The grout dispensing apparatus of claim 14, where in said grout hopper comprises a grout-hopper grout level sensor operatively connected to said grout dispensing device for controlling said grout dispensing device.

16. The grout dispensing apparatus of claim 6, further comprising a self-propulsion device having an engine for self-propulsion, wherein said self-propulsion device is operatively connected to said grout preparation apparatus and said grout dispensing apparatus.

17. The grout dispensing apparatus of claim 16, wherein said self-propulsion device further comprises:

(a) a control panel for controlling operations of said self-propulsion device, said grout preparation apparatus and said grout dispensing apparatus, and (b) a swing arm, wherein said control panel is operatively connected to said swing arm, and wherein said swing arm allows placement of said control panel on the right side or the left side of said self-propulsion device.

18. The grout dispensing apparatus of claim 17, wherein said grout dispensing apparatus is removably attached to said self-propulsion device, and wherein said grout dispensing apparatus can be attached on the right or the left side of said self-propulsion device.

19. The grout dispensing apparatus of claim 18, further comprising a lifting mechanism for lifting said grout dispensing apparatus off of a pavement surface.

20. The grout dispensing apparatus of claim 18, further comprising a guiding device for guiding said grout dispensing apparatus into a proper pavement groove filling position.

21. A grout preparation apparatus comprising:

(a) a product hopper for storing a dry particulate material;

(b) a product dispensing device for dispensing at least a portion of the dry particulate material from said product hopper;

(c) a grout mixer operatively connected to said product-dispensing device for mixing the dry particulate material with a liquid to produce the grout; and (d) a surge hopper operatively connected to said grout mixer for storing the grout;

wherein said product hopper comprises a product-hopper air pad in the interior of said product hopper for providing air flow into said product hopper to reduce the amount of agglomerate formation of the dry particulate material.

22. A grout preparation apparatus comprising:

(a) product hopper for storing a dry particulate material;

(b) a product dispensing, device for dispensing at least a portion of the dry particulate material from said product hopper;

(c) a grout mixer operatively connected to said product-dispensing device for mixing the dry particulate material with a liquid to produce the grout;

(d) a surge hopper operatively connected to said grout mixer for storing the grout; and (e) a grout temperature sensor for determining the temperature of the grout in said surge hopper.

23. The grout preparation apparatus of claim 22, further comprising a product temperature sensor for determining the temperature of the dry particulate material.

24. The grout preparation apparatus of claim 23, further comprising a product heater operatively connected to said product temperature sensor and said grout temperature sensor for heating the dry particulate material.

25. The grout preparation apparatus of claim 22, further comprising a liquid storage device operatively connected to said grout mixer for storing liquid and wherein said grout mixer further comprises a liquid inlet operatively connected to said liquid storage device for supplying liquid to said grout mixer.

26. The grout preparation apparatus of claim 25, further comprising a liquid temperature sensor for determining the temperature of the liquid in said liquid storage device.

27. The grout preparation apparatus of claim 26, further comprising a liquid heater operatively connected to said liquid temperature sensor and said grout temperature sensor for heating the liquid.

28. The grout preparation apparatus of claim 22, further comprising an additive inlet for adding an additive to said grout mixer, wherein the addition of the additive is operatively connected to said grout temperature sensor.

29. A grout preparation apparatus comprising:

(a) a product hopper for storing a dry particulate material;

(b) a product dispensing device for dispensing at least a portion of the dry particulate material from said product hopper;

(c) a grout mixer operatively connected to said product-dispensing device for mixing the dry particulate material with a liquid to produce the grout; and (d) a surge hopper operatively connected to said grout mixer for storing the grout;

wherein said surge hopper comprises a surge-hopper grout level sensor, wherein said surge-hopper grout level sensor is operatively connected to said grout mixer and said product dispensing device for controlling the production of grout and wherein said surge-hopper grout level sensor is an ultrasonic sensor.

30. A grout preparation apparatus comprising:

(a) a product hopper for storing a dry particulate material;

(b) a product dispensing device for dispensing at least a portion of the dry particulate material from said product hopper;

(c) a grout mixer operatively connected to said product-dispensing device for mixing the dry particulate material with a liquid to produce the grout;

(d) a surge hopper operatively connected to said grout mixer for storing the grout; and (e) a self-propulsion device having an engine for self-propulsion operatively connected to said grout preparation apparatus.

31. The grout preparation apparatus of claim 30, wherein said self-propulsion device further comprises:

(a) a control panel for controlling operations of said self-propulsion device and said grout preparation apparatus, and (b) a swing arm, wherein said control panel is operatively connected to said swing arm, and wherein said swing arm allows placement of said control panel on the right side or the left side of said self-propulsion device.

32. The grout preparation apparatus of claim 31, further comprising a grout dispensing apparatus operatively connected to said control panel and said group preparation apparatus, wherein said grout dispensing apparatus comprises:

(a) a grout hopper for storing grout;

(b) a grout hopper grout agitator for agitating the grout in said grout hopper;

(c) a material gate having open and closed positions operatively connected to said grout hopper for dispensing the grout from said grout hopper into a pavement groove when said material gate is in the open position;

(d) a side form for confining the grout substantially within side boundaries of the pavement groove; and (e) an extrusion pan for leveling the grout in the pavement groove.

33. The grout preparation apparatus of claim 32, further comprising a grout hopper vibrator for vibrating said grout hopper.

34. The grout preparation apparatus of claim 32, further comprising a smoothing plate for smoothing the grout surface in the pavement groove and a smoothing-plate vibrator operatively connected to said smoothing plate for vibrating said smoothing plate.

35. The grout preparation apparatus of claim 32, wherein said grout dispensing apparatus further comprises a rollable support system, wherein said rollable support system comprises a longitudinal bogey averaging system and a transversal bogey averaging system.

36. The grout preparation apparatus of claim 32, wherein said grout dispensing apparatus further comprises a lifting mechanism for lifting said grout dispensing apparatus off of a pavement surface and a guiding device for guiding said grout dispensing apparatus into a proper pavement groove filling position.

37. The grout preparation apparatus of claim 32, further comprising:

a visibility-enhancing agent applying device for applying and embedding a visibility-enhancing agent onto the grout surface in the pavement groove; and a grout-surface air spray device for removing non-embedded visibility-enhancing agent from the grout surface in the pavement groove and for further embedding the visibility-enhancing agent into the grout surface.

38. The grout preparation apparatus of claim 32, further comprising a curing-agent applying device for applying a curing agent onto the grout surface in the pavement groove.

39. The grout preparation apparatus of claim 32, wherein said grout dispensing apparatus is removably attached to said self-propulsion device, and wherein said grout dispensing apparatus can be attached on the right or the left side of said self-propulsion device.

40. The grout preparation apparatus of claim 32, wherein said grout preparation apparatus further comprises a grout dispensing device for dispensing the grout from said surge hopper to said grout hopper.

41. The grout preparation apparatus of claim 40, wherein said grout dispensing device is operatively connected to a grout spray device for spraying the grout onto a pavement surface.

42. The grout preparation apparatus of claim 40, wherein said grout dispensing device is a peristaltic pump.

43. The grout preparation apparatus of claim 40, wherein said grout hopper comprises a grout-hopper grout level sensor operatively connected to said grout dispensing device for controlling said grout dispensing device.

44. The grout preparation apparatus of claim 32, further comprising a groove clearing air-spray device for clearing the pavement groove of particles.

45. The grout preparation apparatus of claim 44, further comprising a mist-spray device for spraying water mist into the pavement groove.

46. A pavement groove filling apparatus comprising:

(a) a grout preparation apparatus, wherein said grout preparation apparatus comprises:

(i) a product hopper for storing a dry particulate material, (ii) a grout mixer operatively connected to said product hopper for mixing at least a portion of the dry particulate material with water to produce the grout, (iii) a product dispensing device for dispensing at least a portion of the dry particulate material from said product hopper to said grout mixer, and (iv) a surge hopper operatively connected to said grout mixer for storing the grout; and (b) a grout dispensing apparatus operatively connected to said grout preparation apparatus, wherein said grout dispensing apparatus comprises:

(i) a grout hopper for storing the grout, (ii) a material gate having open and closed positions operatively connected to said grout hopper for dispensing the grout from said grout hopper into a pavement groove when said material gate is in the open position, (iii) a side form for confining the grout substantially within side boundaries of the pavement groove, and (iv) an extrusion pan for leveling the grout in the pavement groove.

47. The pavement groove filling apparatus of claim 46, further comprising a self-propulsion device having an engine for self-propulsion and a swing arm, wherein said swing arm comprises a control panel for controlling operations of said self-propulsion device, said grout preparation apparatus and said grout dispensing apparatus, and wherein said swing arm allows placement of said control panel on the right side or the left side of said self-propulsion device.

48. The pavement groove filling apparatus of claim 47, wherein said grout dispensing apparatus is removably attached to said self-propulsion device, and wherein said grout dispensing apparatus can be attached on the right side or the left side of said self-propulsion device.

49. The pavement groove filling apparatus of claim 46, further comprising a grout temperature sensor for determining the temperature of the grout in said surge hopper.

50. The pavement groove filling apparatus of claim 49, further comprising a product temperature sensor for determining the temperature of the dry particulate material and a product heater operatively connected to said product temperature sensor and to said grout temperature sensor for heating the dry particulate material.

51. The pavement groove filling apparatus of claim 49, further comprising a water storage device operatively connected to said grout mixer for storing water and a water inlet operatively connected to said water storage device and said grout mixer for supplying water to said grout mixer.

52. The pavement groove filling apparatus of claim 51, further comprising a water temperature sensor for determining the temperature of water in said water storage device and a water heater operatively connected to said water temperature sensor and to said grout temperature sensor for heating water.

53. The pavement groove filling apparatus of claim 49, wherein said grout mixer further comprises an additive inlet for adding the additive to said grout mixer, wherein said additive inlet is operatively connected to said grout temperature sensor.

54. The pavement groove filling apparatus of claim 46, wherein said surge hopper comprises a surge-hopper grout level sensor operatively connected to said grout mixer for controlling the production of grout.

55. The pavement groove filling apparatus of claim 46, wherein said grout preparation apparatus further comprises a grout dispensing device for dispensing the grout from said surge hopper to said grout hopper.

56. The pavement groove filling apparatus of claim 55, wherein said grout dispensing device is a peristaltic pump.

57. The pavement groove filling apparatus of claim 55, wherein said grout hopper comprises a grout-hopper grout level sensor operatively connected to said grout dispensing device for controlling said grout dispensing device.

58. The pavement groove filling apparatus of claim 46, wherein said grout dispensing apparatus further comprises a smoothing plate for smoothing the grout surface in the pavement groove, and wherein said smoothing plate is operatively connected to a smoothing-plate vibrator which vibrates said smoothing plate.

59. The pavement groove filling apparatus of claim 46, wherein said grout dispensing apparatus further comprises a rollable support system, wherein said rollable support system comprises a longitudinal bogey averaging system and a transversal bogey averaging system.

60. The pavement groove filling apparatus of claim 59, further comprising a lifting mechanism for lifting said grout dispensing apparatus off of a pavement surface and a guiding device for guiding said grout dispensing apparatus into a proper pavement groove filling position.

61. The pavement groove filling apparatus of claim 46, further comprising a visibility-enhancing agent applying device for applying and embedding a visibility-enhancing agent onto the grout surface in the pavement groove.

62. The pavement groove filling apparatus of claim 61, further comprising a grout-surface air spray device for removing non-embedded visibility-enhancing agent from the grout surface in the pavement groove and for further embedding the visibility-enhancing agent into the grout surface.

63. The pavement groove filling apparatus of claim 46, further comprising a curing-agent applying device for applying a curing agent onto the grout surface in the pavement groove.

64. The pavement groove filling apparatus of claim 46, further comprising a groove clearing air spray device for clearing the pavement groove of particles.

65. The pavement groove filling apparatus of claim 46, further comprising a mist spray device for spraying water mist onto the pavement groove.

66. A self-propelled pavement groove filling apparatus comprising:

(a) an engine for self-propulsion;

(b) a groove clearing air spray device for clearing the pavement groove of particles;

(c) a mist spray device for spraying water mist onto the pavement groove;

(d) a product hopper for storing a dry particulate material;

(e) a product dispensing device comprising a dry product feed auger and a metering auger for dispensing at least a portion of the dry particulate material from said product hopper;

(f) a water storage device;

(g) an additive storage device;

(h) a grout mixer operatively connected to said product dispensing device for mixing the dry particulate material with water to produce the grout;

(i) a water inlet operatively connected to said water storage device for adding water to said grout mixer;

(j) an additive inlet operatively connected to said additive storage device for adding an additive to said grout mixer;

(k) a surge hopper operatively connected to said grout mixer for storing the grout;

(l) a surge hopper grout agitator for agitating the grout in said surge hopper;

(m) a grout dispensing device operatively connected to said surge hopper for dispensing the grout from said surge hopper;

(n) a grout hopper operatively connected to said grout dispensing device for storing the grout;

(o) a grout hopper grout agitator for maintaining homogeneity of the grout in said grout hopper;

(p) a material gate having open and closed positions operatively connected to said grout hopper for dispensing the grout from said grout hopper into a pavement groove when said material gate is in the open position;

(q) a side form for confining the grout substantially within side boundaries of the pavement groove;

(r) an extrusion pan for leveling the grout in the pavement groove;

(s) a smoothing plate for smoothing the grout surface in the pavement groove; and (t) a guiding device for guiding said grout hopper and said material gate into a proper pavement groove filling position.

67. The self-propelled pavement groove filling apparatus of claim 66, further comprising a control panel operatively connected to said engine.

68. The self-propelled pavement groove filling apparatus of claim 67, further comprising a swing arm, wherein said swing arm allows placement of said control panel on the right side or the left side of said self-propelled pavement groove filling apparatus.

69. The self-propelled pavement groove filling apparatus of claim 66, wherein said product hopper comprises a product hopper vibrator for vibrating said product hopper and a product-hopper air pad in the interior of said product hopper for providing air flow into said product hopper to reduce the amount of agglomerate formation of the dry particulate material.

70. The self-propelled pavement groove filling apparatus of claim 66, further comprising a grout temperature sensor for determining the temperature of grout in said surge hopper.

71. The self-propelled pavement groove filling apparatus of claim 70, further comprising a product temperature sensor for determining the temperature of the dry particulate material and a product heater operatively connected to said product temperature sensor and to said grout temperature sensor for heating the dry particulate material.

72. The self-propelled pavement groove filling apparatus of claim 70, further comprising a water temperature sensor and a water heater operatively connected to said water temperature sensor and said grout temperature sensor for heating water.

73. The self-propelled pavement groove filling apparatus of claim 66, wherein said surge hopper comprises a surge-hopper grout level sensor, wherein said surge-hopper grout level sensor is operatively connected to said grout mixer, said additive inlet, said water inlet and said product dispensing device for controlling the production of grout.

74. The self-propelled pavement groove filling apparatus of claim 66, wherein said grout hopper comprises a grout-hopper vibrator for vibrating said grout hopper.

75. The self-propelled pavement groove filling apparatus of claim 66, further comprising a smoothing-plate vibrator operatively connected to said smoothing plate for vibrating said smoothing plate.

76. The self-propelled pavement groove filling apparatus of claim 66, further comprising a visibility-enhancing agent applying device for applying and embedding a visibility-enhancing agent onto the grout surface in the pavement groove.

77. The self-propelled pavement groove filling apparatus of claim 76, further comprising a grout-surface air spray device for removing non-embedded visibility-enhancing agent from the grout surface in the pavement groove and for further embedding the visibility-enhancing agent into the grout surface.

78. The self-propelled pavement groove filling apparatus of claim 66, further comprising a curing-agent spray device for spraying a curing agent onto the grout surface in the pavement groove.

79. The self-propelled pavement groove filling apparatus of claim 66, further comprising a rollable support system operatively connected to said grout hopper, said material gate, said side form, said extrusion pan and said smoothing plate.

80. The self-propelled pavement groove filling apparatus of claim 79, wherein said rollable support system comprises a longitudinal bogey averaging system and a transversal bogey averaging system.

81. The self-propelled pavement groove filling apparatus of claim 80, further comprising a lifting mechanism for lifting said rollable support system off of a pavement surface.

* * * * *

UNITED STATES PATENT AND TRADEMARK OFFICE

CERTIFICATE OF CORRECTION

PATENT NO. : 6,213,680 B1
DATED : April 10, 2001
INVENTOR(S) : Schaeffer et al.

It is certified that error appears in the above-identified patent and that said Letters Patent is hereby corrected as shown below:

Title page,
Item [75], Inventors,
The two additional inventors to be listed on the front of the patent are:

Robert P. Hunsicker, Largo, Florida
Michael E. Urbas, Cleveland Heights, Ohio Signed and Sealed this Sixth Day of August, 2002

*Attest:*

*Attesting Officer*

JAMES E. ROGAN
*Director of the United States Patent and Trademark Office*